US007201945B2

(12) United States Patent
Hirata et al.

(10) Patent No.: US 7,201,945 B2
(45) **Date of Patent: *Apr. 10, 2007**

(54) HEALTHY FIBER PRODUCTS

(75) Inventors: Yoshihiro Hirata, Kyoto (JP); Yoshio Ueda, Kyoto (JP); Hiroaki Takase, Kyoto (JP); Kazuaki Suzuki, Kyoto (JP)

(73) Assignee: Phild Co., Ltd., Kyoto (JP)

( * ) Notice: Subject to any disclaimer, the term of this patent is extended or adjusted under 35 U.S.C. 154(b) by 307 days.

This patent is subject to a terminal disclaimer.

(21) Appl. No.: 10/311,835

(22) PCT Filed: Nov. 29, 2000

(86) PCT No.: PCT/JP00/08394

§ 371 (c)(1),
(2), (4) Date: Apr. 8, 2003

(87) PCT Pub. No.: WO02/02860

PCT Pub. Date: Jan. 10, 2002

(65) Prior Publication Data

US 2004/0213995 A1 Oct. 28, 2004

(30) Foreign Application Priority Data

Jul. 4, 2000 (JP) ..... 2000-201971

(51) Int. Cl.
*B05D 1/02* (2006.01)
*B05D 3/02* (2006.01)
*C23C 4/08* (2006.01)

(52) U.S. Cl. ..... 427/372.2; 427/383.1; 427/421.1; 427/430.1; 427/446; 427/455

(58) Field of Classification Search ..... 442/123, 442/181, 327; 427/372.2, 383.1, 446, 455, 427/430.1, 421.1
See application file for complete search history.

(56) References Cited

U.S. PATENT DOCUMENTS

| | | | | |
|---|---|---|---|---|
| 5,258,228 | A * | 11/1993 | Komuro | 428/402 |
| 5,541,238 | A | 7/1996 | Yamada et al. | |
| 6,077,794 | A * | 6/2000 | Tabata et al. | 442/123 |
| 6,264,967 | B1 * | 7/2001 | Ito et al. | 424/404 |
| 6,841,791 | B2 * | 1/2005 | DeMeo et al. | 250/515.1 |
| 2004/0107798 | A1 | 6/2004 | Hirata et al. | |
| 2004/0118244 | A1 | 6/2004 | Hirata et al. | |
| 2004/0213995 | A1 | 10/2004 | Hirata et al. | |

FOREIGN PATENT DOCUMENTS

| | | | |
|---|---|---|---|
| EP | 0 783 048 | | 7/1997 |
| JP | 401155868 | A * | 6/1989 |
| JP | 04-370270 | | 12/1992 |
| JP | 06-123067 | | 5/1994 |
| JP | 06-192961 | | 7/1994 |
| JP | U 3021113 | | 11/1995 |
| JP | 09-241970 | | 9/1997 |
| JP | U-3050952 | | 5/1998 |
| JP | 10-323399 | | 12/1998 |
| JP | 10-323400 | | 12/1998 |
| JP | 11228141 | A * | 8/1999 |

* cited by examiner

*Primary Examiner*—Ula C. Ruddock
(74) *Attorney, Agent, or Firm*—Knobbe, Martens, Olson & Bear LLP

(57) ABSTRACT

A fiber product offering health-enhancing effects is obtained by causing a fibrous substrate to contain or be bonded with finely divided titanium powder through the process of impregnation with a water solution containing finely divided titanium powder, which is obtained by dissolving metallic titanium via the combustion gas produced by combusting a gaseous oxygen/hydrogen mixture in high-pressure water in a pressure-resistant tank.

7 Claims, 5 Drawing Sheets

[FIG. 1]
Specimen 1 (sprayed)
(a)
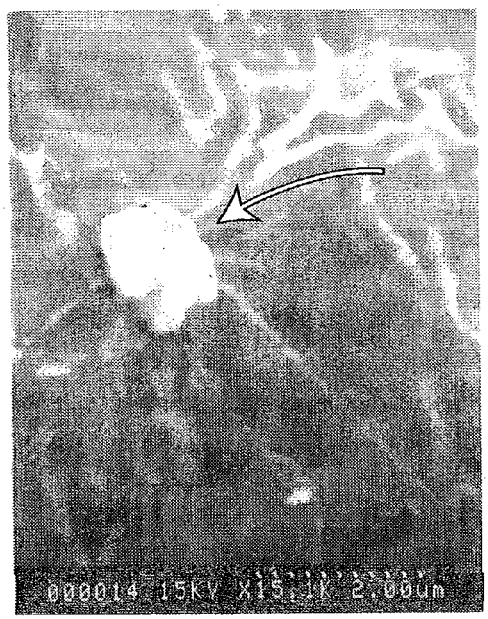
(b)
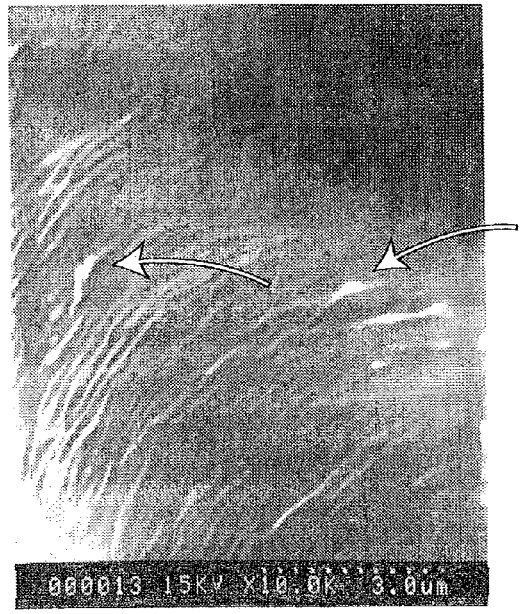
(c)
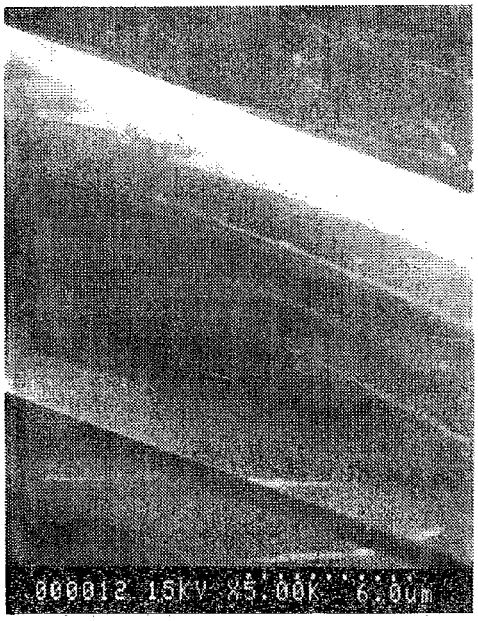

[FIG. 2]
Specimen 2 (immersed)
(a)
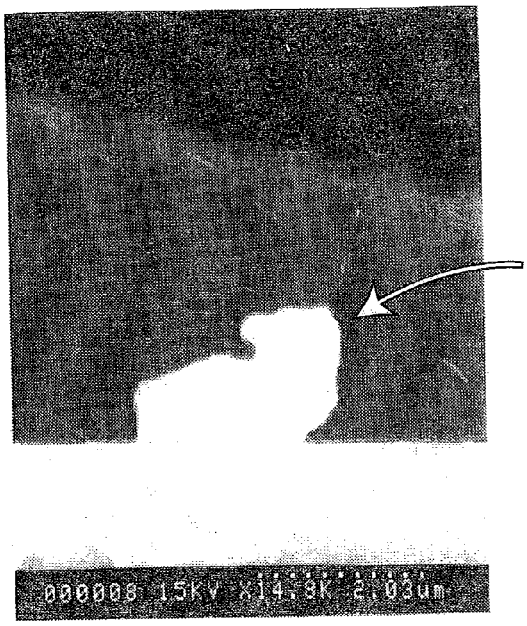
(b)
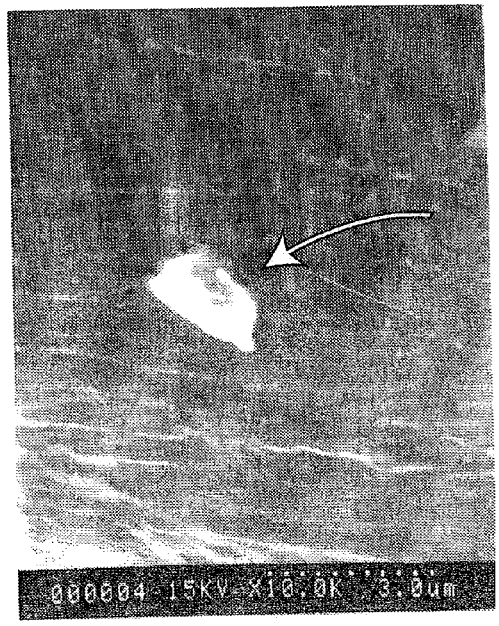
(c)
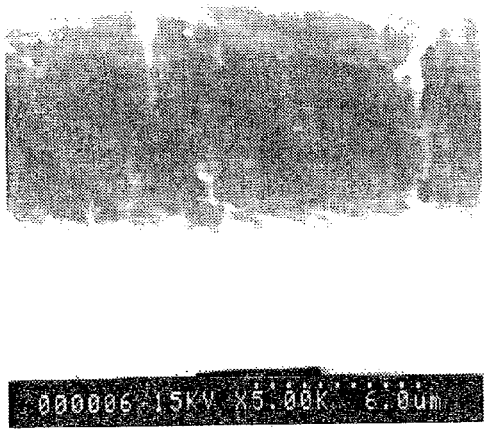

[FIG. 3]
Specimen 3 (untreated)
(a)
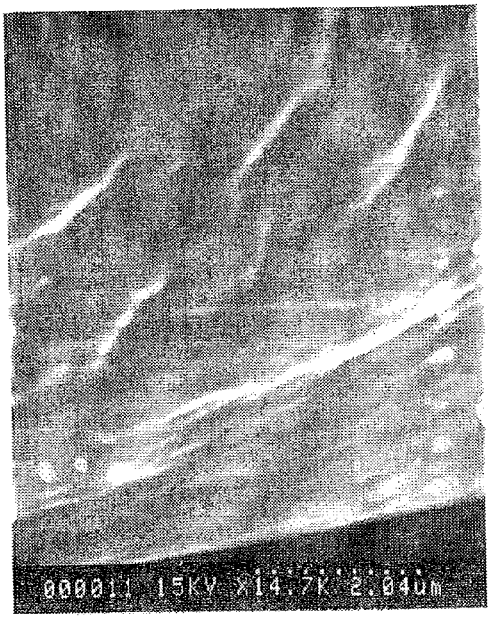
(b)
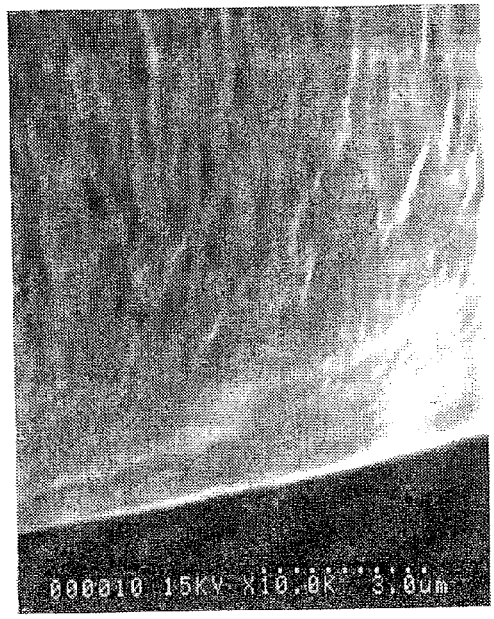
(c)
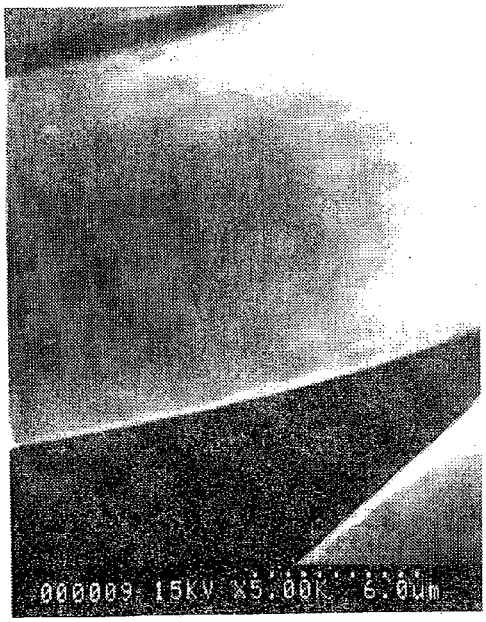

[FIG. 4]
Specimen 4 (sprayed, subjected to five laundry cycles)
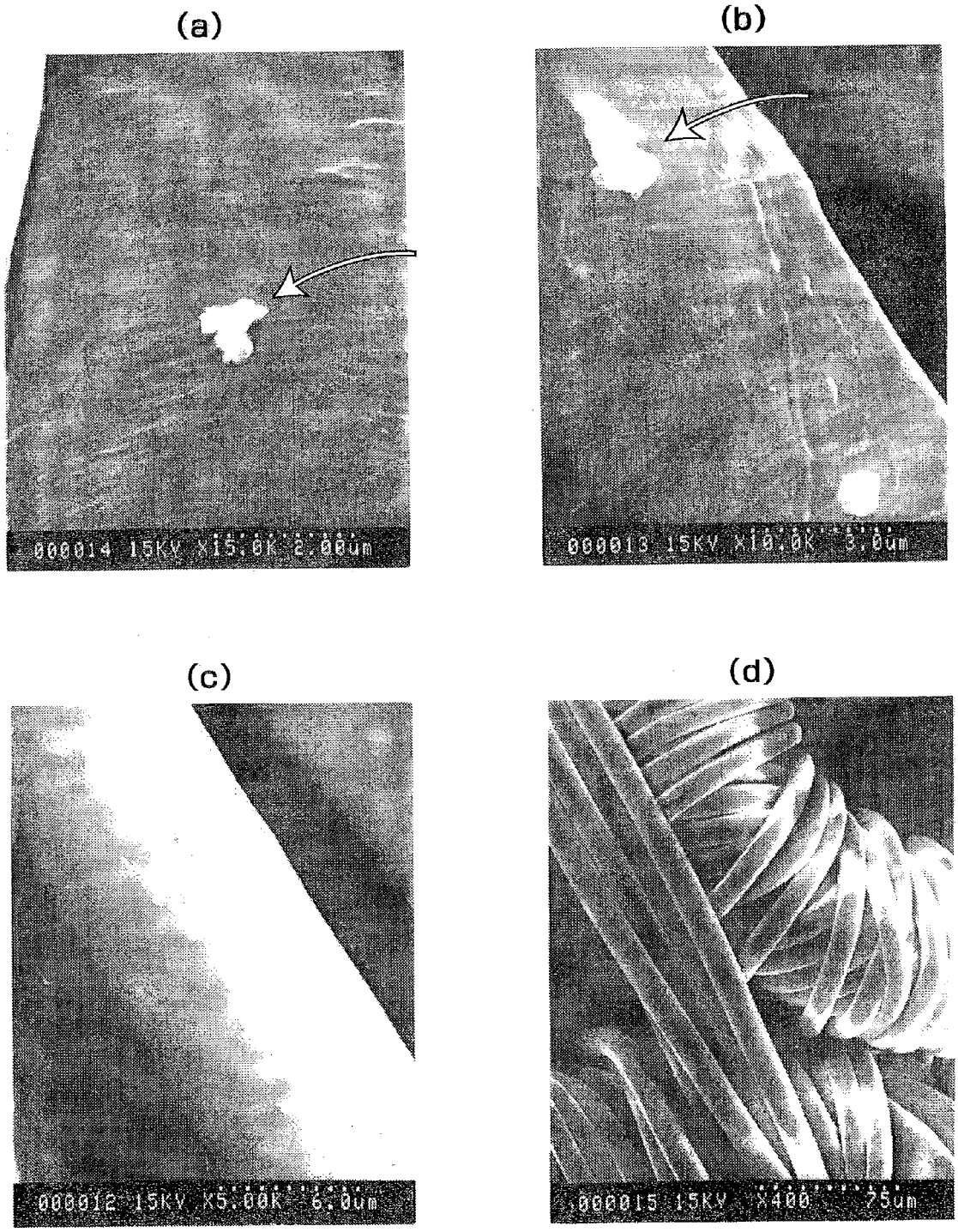

[FIG. 5]
Specimen 5 (immersed, subjected to five laundry cycles)
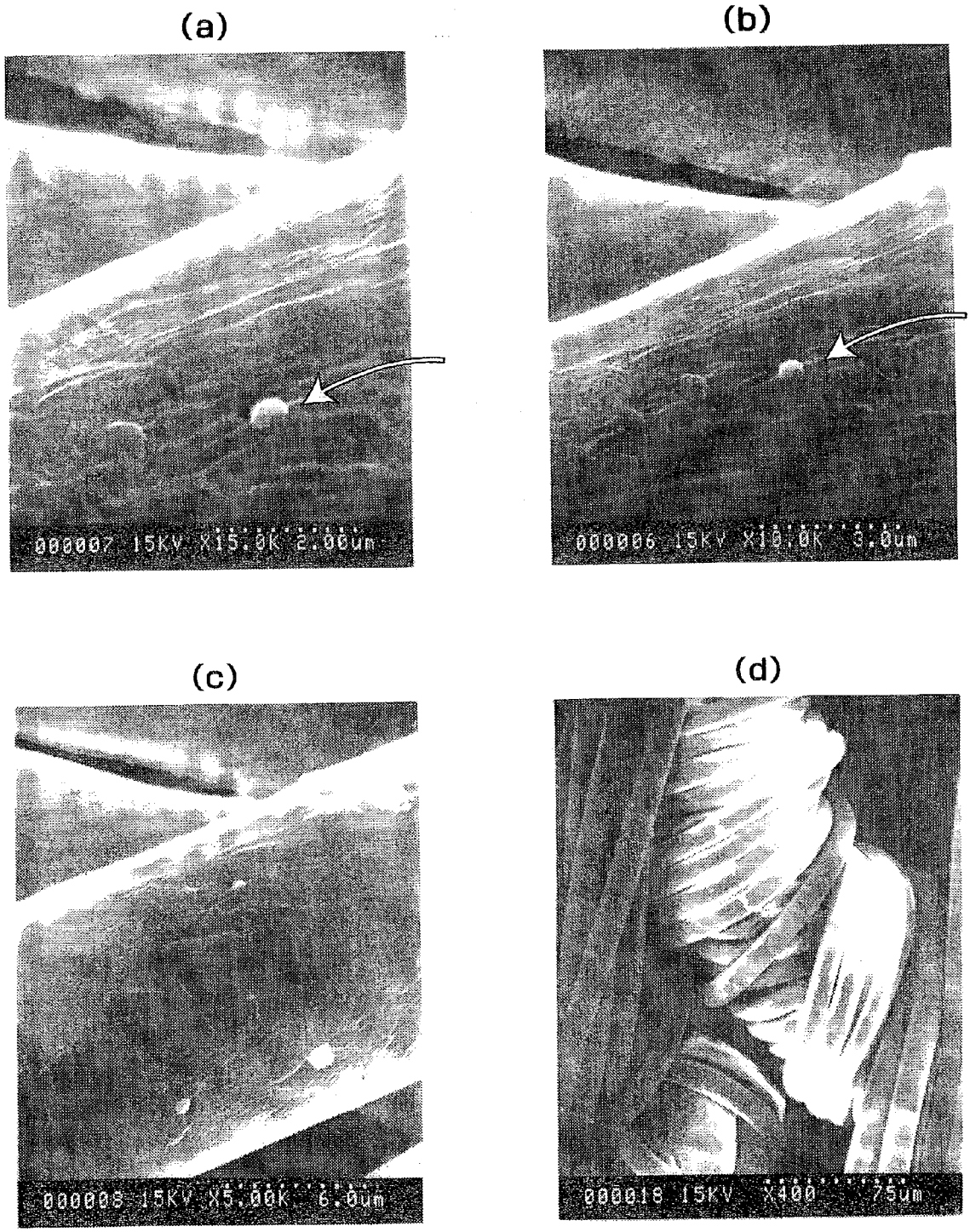

HEALTHY FIBER PRODUCTS

This application is the U.S. National Phase under 35 U.S.C. §371 of International Application PCT/JP00/08394, filed Nov. 29, 2000, which claims priority to Japanese Patent Application No. 2000-201971, filed Jul. 4, 2000. The International Application was published under PCT Article 21(2) in a language other than English.

FIELD OF THE INVENTION

This invention relates to a fiber product containing or bonded with finely divided titanium powder, which is obtained by impregnating a fibrous substrate with a titanium-water solution.

The invention also relates to a healthy fiber product made by allowing pantyhose, socks, gloves, underwear, shirts, fitness/athletic wear, mufflers, supporters, wristbands and other products to contain or be bonded with finely divided titanium powder.

BACKGROUND OF THE INVENTION

Health-enhancing products are drawing more and more attention today, highlighting the recent social trend toward greater health-consciousness. Among such products, the apparel being worn in day-to-day life is being recognized as having the potential to improve and enhance our health. However, while the materials emitting far-infrared and magnetic energies, as disclosed in Japanese Utility Model Application Laid-open Nos. 1-935064 and 5-69104, and the carbonized fiber as disclosed in Japanese Utility Model Application Laid-open No. 63-199110, are among the known healthy fiber products, these products are primarily intended for the cure of diseases, and there aren't many technologies available for treating fibrous substrates for health-enhancement purposes.

Furthermore, certain particles, when bonded to underwear and hosiery, are known to provide deodorizing and antibacterial effects as well as greater appeal to the sense of touch. Examples of such products include underwear that is topically bonded with an odor-absorbing titanium compound like sodium carbonate or sodium hydrogen carbonate (Japanese Patent Application Laid-open No. 52-21951); socks treated with metallophthalocyanine for improved antibiotic and deodorizing effects (Japanese Patent Application Laid-open No. 63-112701, Japanese Utility Model Application Laid-open No. 7-9906); and antibacterial undershorts/panties topically bonded with bivalent or trivalent iron salt (Japanese Utility Model Application Laid-open No. 2-3402).

Among other known products are fragrant pantyhose having textile fabrics bound together with an acrylic-acid binder and using microcapsules containing fragrance as a wall material (Japanese Patent Application Laid-open No. 4-100901); pantyhose containing a mixture of polyoxyalkylene glycol and sulfonic-acid metal salt for improved touch (Japanese Patent Application Laid-open No. 4-241101); non-woven fabric treated with chitin and chitosan derivatives for greater antibacterial and antifungal effects (publication of unexamined patent application No. 4-272273); pantyhose made with an ideal mixture of polyamide fiber that is free of titanium oxide for better transparency, flatness, gloss and fit (Japanese Patent Application Laid-open No. 7-157902); a fiber product treated with chitosan solution for the improved absorption and dissipation of perspiration (Japanese Patent Application Laid-open No. 9-228249); a dress shirt treated with a combination of polysulfonic acid and quaternary ammonium salt for better antistatic effect (Japanese Patent Application Laid-open No. 9-268476); socks, pantyhose and other hosiery bonded with epigallo catechin gallate (Japanese Patent Application Laid-open No. 10-195701); a thermal cloth bonded with ceramic powder (Japanese Patent Application Laid-open No. 11-269761); a fiber structure treated with ascorbic acid for a more refreshing feel and pain-relieving effect (Registered Japanese Patent No. 2562233); socks bonded with tourmaline to reduce foot perspiration and relieve fatigue (Registered Japanese Utility Model No. 3040113); and socks treated with mineral salt (Registered Japanese Utility Model No. 3028232). However, these products have a long way to go in fulfilling the demands of today's health-oriented society.

Compared to such metals as iron, copper or aluminum, metallic titanium is a relatively newly discovered metallic material. The physical properties of titanium—namely its low weight and high strength, the latter of which is exhibited even at high temperatures—have found use in many fields. In the industrial sector, titanium is used in jet engine in the aeronautics and space industry, and in the tubing and tube sheets in the heat exchangers of nuclear and thermal power generators in the energy industry. Titanium is also used in eyeglass frames, golf club heads and other articles of everyday life. Moreover, titanium is likely to expand its range of applications.

The use of metallic titanium in everyday articles, health and medical articles and cosmetics is relatively well known. Examples include barber's scissors with titanium film coatings (Japanese Patent Application Laid-open No. 62-268584); the utilization of far-infrared rays through dissolved metallic titanium (Japanese Patent Application Laid-open Nos. 61-59147, 1-155803 and 3-112849); bedding (Japanese Patent Application Laid-open No. 8-322695); cooking utensils (Japanese Patent Application Laid-open No. 9-140593); eye masks (Japanese Patent Application Laid-open No. 10-71168); health-maintenance devices (Japanese Patent Application Laid-open Nos. 11-285541 and 11-285543); health bands (Registered Japanese Utility Model No. 3045835); and health slippers (Registered Japanese Utility Model No. 3061466). However, no attempt has been made to bond fiber materials, such as clothing and garments, with metallic titanium for health-enhancement purposes.

As mentioned earlier, there are no known technologies that use metallic titanium for functional water or the like, except that a relevant technology is applied to the drinking-water production system that takes advantage of electro-osmosis with the use of metallic titanium as a negative electrode (Japanese Patent Application Laid-open No. 50-40779). While much is anticipated regarding the potential applications of titanium in the fields of bioactive materials, food ingredients and medical products, to date none of those potential applications has taken shape.

The inventors of the present invention have studied the effective use of titanium for health purposes, and as a result have developed a highly functional water—which contains dissolved titanium obtained by combusting the metallic titanium at high temperature generated by the combustion gas, which is in turn produced by burning oxygen and hydrogen in high-pressure water within a pressure-resistant container—along with a method and apparatus for manufacturing the same. A patent application has already been filed for the above invention (Japanese Patent Application No. 2000-136932). The present invention is intended to apply the titanium-dissolved water obtained through the above manufacturing method and apparatus for use in the treatment of fibrous substrates.

DISCLOSURE OF THE INVENTION

Among a great number of health drinks, health foods, health equipment and other health-enhancing products disclosed to the public, the use of materials with health-enhancing features in everyday clothing is considered the most effective. However, few techniques manifested in the prior art have been directed toward fiber products designed for health-improvement purposes.

Given the circumstances described above, the inventors hereof have earnestly conducted studies regarding inexpensive, general-purpose healthy fiber products that are in agreement with the direction of contemporary health trends and are effective in terms of health enhancement.

The purpose of the present invention is to apply titanium's superior functions to the human body through the impregnation of fibrous substrates with functional water containing the aforementioned, finely divided titanium powder, in order to provide healthy fiber products that help activate biological cells, limit excessive perspiration, relieve fatigue and positively affect other health factors.

The present invention is intended to solve the existing problems described above, and is directed toward healthy fiber products made of fibrous substrates containing or bonded with titanium.

Through an effort to develop a material offering a number of excellent functional features with the goal of developing innovative healthy fiber products, the present invention has succeeded in producing superior healthy fiber products by selecting titanium as a material offering functionality and the fibrous substrate as a base material, as well as by allowing the fibrous substrate to contain or be bonded with finely divided titanium powder.

The present invention is directed toward healthy fiber products that are allowed to contain or be bonded with finely divided titanium powder through impregnation of the fibrous substrate with the titanium-water solution and subsequent drying, and is capable of providing healthy fiber products by allowing the non-woven or woven fabric used as a fibrous substrate to contain or be bonded with finely divided titanium powder.

The fibrous substrate of the present invention refers to the non-woven or woven fabric obtained from natural fibers, cotton, rayon, acetate or other natural/semisynthetic fibers, polyacrylic fibers, polyvinyl alcohol fibers, polyester fibers, polyamide fibers or other synthetic fibers.

Examples of fiber products containing or bonded with finely divided titanium powder in the present invention include pantyhose, socks, gloves, underwear, shirts, fitness/athletic wear, mufflers, supporters and wristbands.

The process of impregnation with the titanium-water solution of the present invention refers to the process in which the fibrous substrate is allowed to contain or be bonded with finely divided titanium powder by impregnating the fibrous substrate with the normally used treatment solution or spraying the treatment solution onto the fibrous substrate.

While the titanium used in the present invention has traditionally been called the "mysterious life power" and is known to provide many beneficial features such as deodorizing, antibacterial, antifungal and fire-retardant actions, the inventors hereof have become the first to identify that the titanium provides outstanding health-enhancing features when used in contact with the human body. The mechanism of improvement in the health-enhancing features through use in contact with the human body has yet to be theoretically demonstrated, but it is speculated that such an effect is attributable to the perspiration, muscular metabolism, and blood purification promoted through the body's key points or "pressure points" by enabling the fibrous substrate, which comes in contact with the human skin, to retain titanium through means of the present invention.

BRIEF DESCRIPTION OF THE DRAWINGS

FIG. 1: The views of the surface conditions of the fibrous substrate sprayed with the titanium-water solution depict the degree of adhesion of finely divided titanium powder (specimen 1).

FIG. 2: The views of the surface conditions of the fibrous substrate impregnated with the titanium-water solution similarly depict the degree of adhesion of finely divided titanium powder (specimen 2).

FIG. 3: The views of the untreated substrate obviously show no signs of change on the surface (specimen 3).

FIG. 4: The views of the specimen shown in FIG. 1 after five laundry cycles depict the presence of finely divided titanium powder on the surface of the sprayed fibrous substrate (specimen 4).

FIG. 5: The views of the specimen shown in FIG. 2 after five laundry cycles depict the presence of finely divided titanium powder on the surface of the impregnated fibrous substrate (specimen 5).

BEST MODE FOR CARRYING OUT THE INVENTION

Used as the water containing dissolved titanium in the present invention is the highly functional water containing finely divided titanium powder, such dissolved titanium being obtained by combusting metallic titanium at high temperature via the combustion gas generated by burning oxygen and hydrogen in high-pressure water within a pressure-resistant container, as described in the aforementioned Japanese Patent Application No. 2000-136932.

In the present invention, the aforementioned healthy fiber products can be obtained by impregnating said fibrous substrate with the above-described water solution containing titanium, completely drying the treatment solution, and allowing finely divided titanium powder to adhere to or be retained on the surface of the fibers.

The treatment using the functional water containing finely divided titanium powder in the present invention may be performed on the fibrous substrate, or such an impregnation process may be performed on finished products such as pantyhose, socks, gloves, underwear, shirts, fitness/athletic wear, mufflers, supporters and wristbands, as mentioned above.

In the present invention, the health-enhancing features of metallic titanium can be effectively used by turning a fibrous fiber into a healthy fiber product through the bonding or impregnation of finely divided titanium powder.

The actions and effects inherent to the present invention can be best demonstrated in pantyhose, but the expected effects are fully achieved in other products, as well. The present invention involves the process of impregnating the fibrous substrate with the water solution containing finely divided titanium powder. FIGS. 1 through 5 show the magnified images under an electron microscope depicting the degree of adhesion to the surface of the fiber following the process of impregnation with titanium.

FIG. 1 (specimen 1) shows the views of the surface conditions of the fibrous substrate sprayed with the titanium-water solution, clearly depicting the degree of adhesion of finely divided titanium powder.

FIG. 2 (specimen 2) shows the views of the surface conditions of the fibrous substrate impregnated with the titanium-water solution, clearly depicting the degree of adhesion of finely divided titanium powder.

FIG. 3 (specimen 3) shows the views of the untreated substrate, obviously showing no signs of change on the fibrous surface.

FIG. 4 (specimen 4) shows the views of the specimen shown in FIG. 1 after five laundry cycles, depicting the presence of finely divided titanium powder on the surface of the sprayed fibrous substrate.

FIG. 5 (specimen 5) shows the views of the specimen shown in FIG. 2 after five laundry cycles, depicting the presence of finely divided titanium powder on the surface of the impregnated fibrous substrate.

The finely divided titanium powder is marked with an arrow (←) in the photographs.

The test results demonstrating the beneficial effects of the healthy fiber products relating to the present invention are described below.

Panel testing was performed (by five panelists) using fiber products (A) and (B) of the present invention and fiber products (C) and (D) prepared as comparative samples.

Tested Fiber Products (A) Nylon pantyhose made by treating with the titanium-dissolved water and allowing the titanium to be retained on the surface of the fibrous substrate (sample of the invention).

(B) Underwear made from polyester-cotton blended fabric treated with the titanium-dissolved water to cause titanium retention (sample of the invention).

(C) Untreated nylon pantyhose (comparative sample).

(D) Untreated underwear made from polyester-cotton blended fabric (comparative sample).

Evaluation Criteria

The test results were evaluated by averaging the subjective sensory ratings from ○ to X provided by five panelists from the standpoints of sweating action, fatigue relief, vitality and other items.

I) a: Sweating action, b: Feeling of fatigue relief, c: Enhanced vitality and energy II) ⊙: Good, ○: Moderately good, ◇: Fair, X: No effect observed The obtained test results are shown in Table 1.

TABLE 1

| Health product | New | One laundry cycle | Five laundry cycles | 10 laundry cycles |
|---|---|---|---|---|
| A-a | ⊙ | ⊙ | ⊙ | ○ |
| A-b | ⊙ | ⊙ | ○ | ○ |
| A-c | ⊙ | ⊙ | ○ | ○ |
| B-a | ⊙ | ⊙ | ⊙ | ⊙ |
| B-b | ⊙ | ⊙ | ⊙ | ○ |
| B-c | ⊙ | ⊙ | ○ | ○ |
| C-a | ○ | ◇ | X | X |
| C-b | X | X | X | X |
| C-c | X | X | X | X |

TABLE 1-continued

| Health product | New | One laundry cycle | Five laundry cycles | 10 laundry cycles |
|---|---|---|---|---|
| D-a | ○ | ◇ | ◇ | X |
| D-b | ○ | X | X | X |
| D-c | X | X | X | X |

Evaluation of Test Results

The above test results indicated that the fiber products obtained in the present invention demonstrate excellent sweating action, fatigue relief, vitality improvement and other health-enhancing features through the bonding of finely divided titanium powder, and that such features offered by finely divided titanium powder adhering to the fiber do not degrade significantly even after repeated laundry cycles.

INDUSTRIAL FIELD OF APPLICATION

As explained above, the fiber products containing or bonded with finely divided titanium powder relating to the present invention provide superior effects in terms of health enhancement through the promotion of sweating action, relief from fatigue and improvement of metabolism, and are extremely useful as highly functional fiber products. Furthermore, the healthy fiber products containing or bonded with finely divided titanium powder obtained in the present invention have great resistance to repeated laundering.

What is claimed is:

1. A method for producing a fiber product containing or bonded with finely divided titanium metal powder, which comprises:

providing a fibrous substrate composed of fibers;

provising a titanium metal-water solution obtained by burning a gaseous mixture of oxygen and hydrogen in high-pressure water to heat and granulate metallic titanium in the water;

imbuing the fibrous substrate with the titanium metal-water solution, thereby attaching titanium metal particles in the titanium metal-water solution to surfaces of the fibers of the fibrous substrate; and drying the resultant fibrous substrate to obtain the fiber product.

2. The method as described in claim 1, wherein said fibrous substrate is non-woven or woven fabric.

3. The method as described in claim 1, wherein said product is pantyhose, socks, gloves, underwear, shirts, fitness/athletic wear, mufflers, supporters or wristbands.

4. The method as described in claim 2, wherein said product is pantyhose, socks, gloves, underwear, shirts, fitness/athletic wear, mufflers, supporters or wristbands.

5. The method as described in claim 1, wherein said fibers are natural fibers, cotton, rayon, acetate or other natural/semisynthetic fibers, polyacrylic fibers, polyvinyl alcohol fibers, polyester fibers, polyamide fibers or other synthetic fibers.

6. The method as described in claim 1, wherein the imbuing step comprises immersing the fibrous substrate in the titanium metal-water solution.

7. The method as described in claim 1, wherein the imbuing step comprises spraying the fibrous substrate with the titanium metal-water solution.

* * * * *